US006533554B1

(12) United States Patent
Vargo et al.

(10) Patent No.: US 6,533,554 B1
(45) Date of Patent: Mar. 18, 2003

(54) THERMAL TRANSPIRATION PUMP

(75) Inventors: Stephen E. Vargo, Pasadena, CA (US); E. Phillip Muntz, Pasadena, CA (US); Geoff R. Shiflett, Culver City, CA (US)

(73) Assignee: University of Southern California, Los Angeles, CA (US)

( * ) Notice: Subject to any disclaimer, the term of this patent is extended or adjusted under 35 U.S.C. 154(b) by 0 days.

(21) Appl. No.: 09/704,363

(22) Filed: Nov. 1, 2000

Related U.S. Application Data

(60) Provisional application No. 60/162,925, filed on Nov. 1, 1999.

(51) Int. Cl.[7] ..... F04B 19/24; F04F 1/18

(52) U.S. Cl. ..... 417/207; 417/48; 417/53

(58) Field of Search ..... 417/207, 48, 51, 417/53

(56) References Cited

U.S. PATENT DOCUMENTS

| | | | | | |
|---|---|---|---|---|---|
| 5,342,431 | A | * | 8/1994 | Anderson et al. | 95/45 |
| 5,729,984 | A | * | 3/1998 | Hemmerrich et al. | 62/50.2 |
| 5,869,152 | A | * | 2/1999 | Colon | 428/34.4 |
| 5,871,336 | A | | 2/1999 | Young | 417/207 |
| 6,114,048 | A | * | 9/2000 | Jech et al. | 428/547 |
| 6,120,751 | A | * | 9/2000 | Unger | 424/9.51 |
| 6,186,768 | B1 | * | 2/2001 | Schmitt | 425/550 |

OTHER PUBLICATIONS

G. Pham–Van–Diep, P. Keeley, E.P. Muntz, D.P. Weaver, *A Micromechanical Knudsen Compressor*. In J. Harvey and G. Lord, editors, *Rarefied Gas Dynamics*, pp. 715–721. Oxford University Press, 1995.

Stephen Vargo, E.P. Muntz, *An Evaluation of Multiple–Stage Micromechanical Knudsen Compressor and Vacuum Pump. Rarefied Gas Dynamics*, Proceedings of the 20$^{th}$ International Symposium on Rarefied Gas Dynamics, pp. 995–1000, 1997.

Y. Sone, E. Itakura, *Analysis of Poiseuille and Thermal Transpiration Flow for Arbitrary Knudsen Numbers by a Modified Knudsen Number Expansion Method and Their Database, J. Vacuum Soc. Jpn.*, 38:92–94, 1990 (translated from Japanese).

Y. Sone, K. Yamamoto, *Flow of a Rarefied Gas Through a Circular Pipe, Phys. Fluids*, 11:1672–1678, 1968. erratum Phys. Fluids, 1970, 12, 2031.*

Vargo et al. "An Evaluation of a Multiple–Stage Micromechanical Knudsen Compressor", Proceedings of the 20$^{th}$ International Symposium on Rarefied Gas Dynamics, pp. 995–1000.*

Orner, et al. "The Application of Thermal Transpiration to a Gaseous Pump", 1970, Journal of Basic Engineering, Transactions of the ASME, pp. 294–302.*

* cited by examiner

*Primary Examiner*—Charles G. Freay
*Assistant Examiner*—Han L. Liu
(74) *Attorney, Agent, or Firm*—Fish & Richardson P.C.

(57) ABSTRACT

A pump comprises a first thermal guard having holes therethrough for passing a gas, a second thermal guard having holes therethrough for passing the gas, a porous thermal transpiration material disposed between the first thermal guard and the second thermal guard, and a heating mechanism to maintain a temperature difference between the thermal guards across the thermal transpiration material.

50 Claims, 3 Drawing Sheets

THERMAL TRANSPIRATION PUMP

CROSS-REFERENCES TO RELATED APPLICATIONS

The present application claims the benefit of U.S. Provisional Application Patent No. 60/162,925 filed Nov. 1, 1999.

BACKGROUND OF THE INVENTION

1. Field of the Invention

The present invention relates generally to the field of gas pumps, and, more particularly, to a thermal transpiration pump, or compressor. Although the present invention may subject to a wide range of applications, it may be especially suited for use in portable and in situ instruments. Throughout the text, pump, vacuum pump, and compressor will often be used interchangeably in describing embodiments of the invention.

2. Description of the Related Art

Pumps are required for the evacuation of a gas space or to draw in a gas sample from the local ambient environment in numerous systems. Many of these systems, such as, gas sensors, chemical reactors, and electron optical devices are important research instruments that may need rough (760 Torr–1 mTorr), high (1 mTorr–$10^{-7}$ Torr) and possibly ultra-high ($10^{-7}$ Torr–$10^{-11}$ Torr) vacuum levels in order to function properly. A great number of these instruments are in the process of being miniaturized into microelectromechanical systems (MEMS) in order to take advantage of the smaller resultant system mass, volume, and power consumption usually obtained through miniaturization. The fabrication of MEMS devices are achieved utilizing processing techniques and equipment developed for the integrated circuit industry. The benefits miniaturization enables has led to commercial as well as governmental interest in the development of portable, integrated analytical instruments. Mass spectrometers, optical spectrometers, gas chromatographs, electron beam optics and on-demand gas generators are some of the devices in various stages of MEMS development.

The currently available commercial rough pumps may not meet the requirements imposed by the miniaturized analytical instruments proposed for portable use. Commercial pumps are typically oversized for the small flows needed and pose serious technical challenges towards their miniaturization. In these small instrument systems the pump tends to have the greatest mass, volume, power consumption and cost penalties. Obviously, miniaturized and possibly integrated pumps would greatly increase the attractiveness of these types of instruments. The few existing miniaturized pumps, for example, mesoscale pumps and micropumps, suffer from negative scaling issues, poor performance, constrained operation or detrimental system impacts. Pump selection for portable and in situ instruments heavily depends on the system's requirements for contamination, noise, vibration, reliability and on the budget allocations for power, size and mass.

More recently several thermal transpiration pump configurations have been suggested. Thermal transpiration describes the regime where gas flows can be induced in a system by maintaining temperature differences across orifices, porous membranes, or capillary tubes under rarefied conditions. The driving reason for these attempts has been the attraction of a pump or compressor with no moving components and no fluids. The major disadvantages are that such pumps have low volume flow rates and tend to be energy inefficient. A further drawback is a low pressure limit for pumping significantly lower than 1 mTorr. The limit appears because it is generally assumed that certain critical pump components must be at least a factor of ten larger than the molecular mean free path of the working gas.

A need therefore exists for a pump for miniaturized system usage that can operate under free molecular conditions over a wide and useful pressure range.

DESCRIPTION OF THE PREFERRED EMBODIMENTS

The present invention resides in a MEMS fabricated pump for miniaturized systems. The pump described herein provides advantages over known thermal transpiration pumps in that it operates under free molecular conditions over a wide and useful pressure range, for example, from about 1 mTorr to above 760 Torr. The recent availability of nanopore membranes in materials with very low thermal conductivity has significantly expanded the utilization of thermal transpiration as a pumping mechanism.

Figure 1:
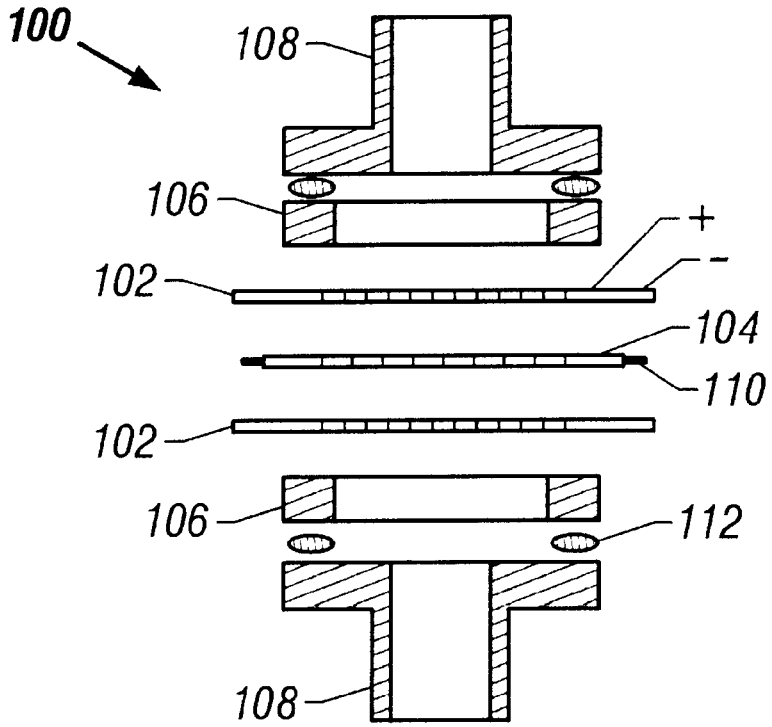
FIG. 1 is a simplified exploded, cross-sectional, side schematic of an embodiment of a single stage pump configured according to the present invention.

FIG. 1 is a simplified exploded, cross-sectional, side schematic of an embodiment of a single prototype stage pump 100 configured according to the present invention. This particular MEMS pump has two silicon chips 102, which are preferably each 2.025 cm×2.025 cm and 400 $\mu$m thick, an aerogel membrane 104 (preferably 520 $\mu$m thick), two Corning Pyrex® 7740 plenums 106, and two aluminum vacuum connectors 108. The silicon chips (a hot side and cold side) and the aerogel, which is a porous membrane made of suspended $SiO_2$ particles, serve as the thermal guards and transpiration membrane, respectively.

Figure 2:
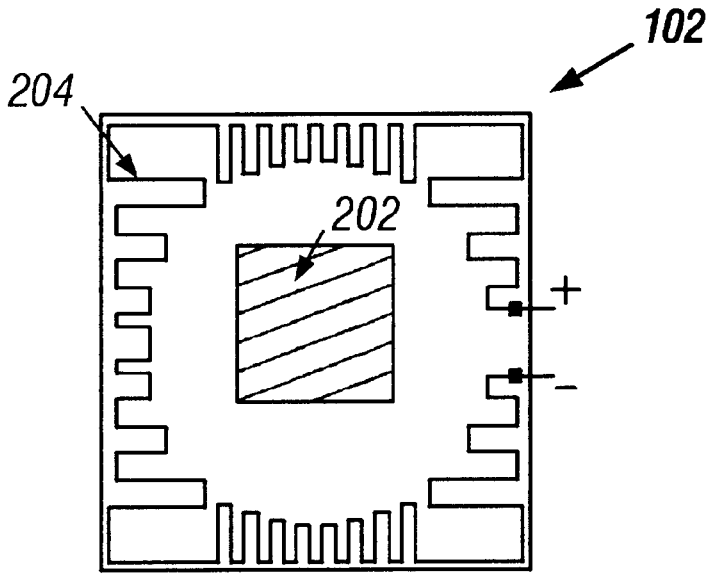
FIG. 2 is a simplified top schematic of a silicon chip, shown in FIG. 1, configured according to the present invention.
Figure 3A:
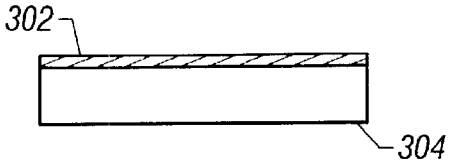
FIG. 3 is a schematic of the metallization process in fabricating the silicon chip shown in FIG. 2.
Figure 3D:
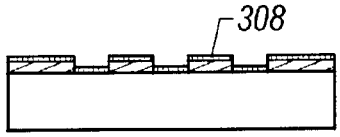
Figure 3B:
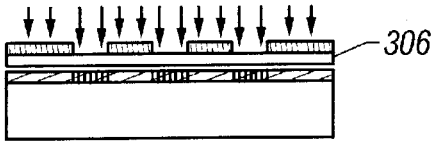
Figure 3E:
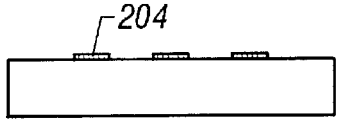
Figure 3C:
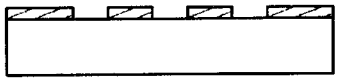
Figure 4A:
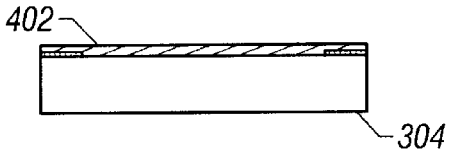
FIG. 4 is a schematic of the etching process in fabricating the silicon chip shown in FIG. 2.
Figure 4D:
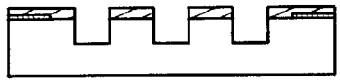
Figure 4B:
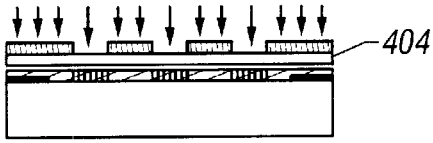
Figure 4E:
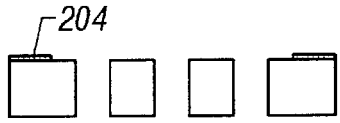
Figure 4C:
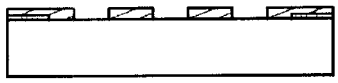

FIG. 2 shows a simplified top schematic of a silicon chip. Each silicon chip 102 can be deep reactive ion etched (DIE) with a dense array (0.5 $cm^2$) of 20 $\mu$m diameter holes 202 through the chip's thickness (i.e. cylindrical tubes) for gas passage. A thin gold film heater 204 can be patterned on each silicon chip to heat the device to temperatures warmer than ambient. The heater acts a resistive path to an applied current and resistively heats to a desired hot temperature ($T_H$) needed for stage operation.

Silicon was selected in this embodiment because it is readily understood and available. A skilled artisan will recognize that other materials could also be used, for example, ceramic, silicon dioxide, or silicon nitride.

Further, other mechanisms are available for heating the device, for example, actively cooling the cool side, irradiating the hot side, or igniting a fuel gas with a catalyst on the hot side.

The hole size, array pattern, and number of holes are selected to provide a relatively unchanged gas flow through the thermal guard and facilitate heat transfer between the gas molecules and thermal guard. The gas flowing through the thermal guard is in the continuum regime as opposed to the free molecular flow regime that exists in the transpiration membrane.

The Knudsen number in the thermal guard should be on the order of 100 times the Knudsen number in the transpiration membrane. This can be achieved by selecting the size of the holes relative to the size of the pores in the transpiration membrane.

The aerogel 104 can have an average pore size of 20 nm and a very low thermal conductivity (17 mW/mK at 760 Torr, 8 mW/mK at p<1 Torr) providing the requirements for thermal transpiration to result when a voltage is applied to one of the heaters. In normal operation, the cold side need not be actively cooled and remains cooler than the hot side due to the sandwiched aerogel membrane.

A thin perimeter bead of Torr Seal® epoxy 110 is used to secure the thermal guards and aerogel together. The Pyrex plenums 106 can be anodically bonded to the silicon chips 102 and serve as mating pieces to two machined aluminum vacuum connectors 108.

Vacuum tubing (not shown) can be attached to the machined aluminum pieces to connect the device to pumping and gas input lines. Gas pumping in the device is made possible by establishing a temperature gradient across the aerogel membrane using the hot side's heater.

The MEMS device's thermal guards 102 can be fabricated with a dense array of 20 $\mu$m diameter holes located in the center of each guard. Accurate placement, size and number of these holes are possible using the batch fabrication capabilities enabled by the use of photolithography and etching systems developed for the integrated circuit industry. The aerogel membrane can have a pore distribution centered around an average pore size of 20 nm. The uncertainty in this pore size is more than balanced by the small pore size and very low thermal conductivity of the aerogel.

Minimal heat transfer across the transpiration membrane 104 is important to efficient thermal transpiration in the pump. Large heat transfer between the hot and cold side of a stage results in low temperature gradients and hence small pressure increases across the membrane. The use of a preferably 520 $\mu$m thick aerogel membrane provides thermal isolation between the two sides of a stage. A deposited thin-film heater 204 on one of the to silicon chips is powered with a small voltage in order to establish the thermal gradient. The cold side is normally not actively cooled and but still remains cooler than the hot side.

The use of silicon for the MEMS thermal guards 102 allows the heater temperature to be uniformly conducted throughout the chip since silicon has a high thermal conductivity. The gradient established between the silicon chips can be maintained using the isolating aerogel 104 due to its extremely low thermal conductivity. During actual heating of the hot side, the Torr Seal epoxy 110, which vacuum seals the device around the perimeter edge of all three components, is the dominant heat transfer path between the two sides. This occurs because Torr Seal has a thermal conductivity at least 26 times higher than the aerogel. Although the epoxy represents the greatest heat transfer path in the MEMS device, the temperature gradient in the center of the device is sufficiently large to make this exterior heat transfer manageable.

The MEMS pump shown in FIG. 1 is fabricated using available materials and fabrication techniques. Miniaturization of the pump has been accomplished using MEMS fabrication techniques and the results are shown in Table 1. The resulting device shown in FIG. 1 consists of silicon, aerogel, pyrex, and aluminum components. Selected mechanical and thermal properties of these materials are included for reference in Table 2. The following sections discuss the fabrication steps and material properties of the resulting MEMS thermal guards, transpiration membrane, and vacuum connectors.

TABLE 1

| Component | Material | ρ, g/cm$^3$ | $K_m$, W/mK | m, g | V, cm$^3$ |
|---|---|---|---|---|---|
| Thermal guard | Si | 2.33 | 150 | 0.378 | 0.163 |
| Transpiration membrane | Aerogel | 0.1 | 0.017 | 0.021 | 0.213 |
| Epoxy | Torr Seal | 1.6 | 0.435 | 0.097 | 0.061 |
| Total | | | | 0.875 | 0.677 |

TABLE 2

| Material | ρ, g/cm$^3$ | $K_m$, W/mK | Specific heat, J/gK | Linear Thermal Expansion, $1 \times 10^{-6}$/K | Maximum use temperature, K. |
|---|---|---|---|---|---|
| Si | 2.33 | 150 | 0.7 | 4.2 | 1685 |
| Aerogel | 0.1 | 0.017 | 1.0 | 3.0 | 773 |
| Pyrex 7740 | 2.23 | 1.13 | 0.753 | 3.25 | 763 |
| Torr Seal | 1.6 | 0.435 | 0.83 | 30.3 | 423 |
| Al 6061 | 2.70 | 180 | 0.9 | 23.6 | 890 |

Thermal guards 102 provide a mechanism by which incoming molecules have their temperature adjusted to desired values before they pass through the transpiration membrane. Those molecules striking and passing through the thermal guard structure towards the transpiration membrane are more likely to first accommodate to a desired temperature. The temperature gradient across the faces of the transpiration membrane is the gradient causing the thermal transpiration. Utilizing a thermal guard material of high thermal conductivity helps to minimize the gradient that may exist across the thermal guard during operation and results in a uniform temperature throughout the guard. Silicon can be chosen as the material of the thermal guard in the MEMS device since it has a high thermal conductivity (150 W/mK) and can be "machined" to a desired structure using standard MEMS processing procedures and equipment.

These guards can be fabricated in silicon wafers using standard MEMS processing techniques that either selectively remove (silicon is etched for the holes and chip dimensions) or selectively add materials (metals are deposited for the heater). The actual layout (location, geometry and number) of desired patterns for the thermal guards are transferred to the wafer using photolithographic patterning techniques. Masks, which are used to optically transfer the image of desired features to the wafer, have a glass plate with clear and opaque areas printed on one side. The actual pattern on the mask is generated using a thin layer of chrome patterned with an electron beam writing system (beam spot size <0.1 μm) or high-resolution (line widths >25 μm ) ink printing techniques. Chrome masks are used when very small (~1 μm) features are needed or when the density of small features is quite large. The mask used for patterning the hole array (20 μm diameter holes, spaced by 40 μm in both x and y directions) in the thermal guards is a chrome mask. The larger feature heater pattern (75 μm lines) is made from high-resolution ink printing on a transparency sheet. This transparency is then attached to a clear glass plate for use. Wafers are first coated with a thin, light-sensitive material (photoresist) that is exposed using the masks and a high-intensity ultraviolet (UV) light source in a mask aligner system. Once exposed, the transferred images are developed in a liquid developer bath which removes exposed regions of photoresist. This patterned photoresist protects areas of the underlying material during subsequent processing. Eight individual thermal guards can be fabricated from a 400 μm thick, 100 mm diameter double-side polished silicon wafer.

The fabrication process can be divided into metallization and etching.

A method of the metallization process for the thermal guard heaters 102 is shown in FIG. 3. It begins by spinning a thin layer of photoresist onto a clean wafer 304 which is then soft baked prior to UV exposure (FIG. 3(*a*)). The wafer is placed underneath the transparency heater mask 306 and the heater pattern is exposed onto the photoresist using the UV light source (FIG. 3(*b*)). The wafer is then placed in a developer bath which removes the areas where light has exposed the photoresist (FIG. 3(*c*)). Once patterned, the wafer is placed in an electron-beam evaporator where the metallization takes place under high-vacuum conditions. The metallization begins with a 300 Å thick layer of chrome, forming an adhesion promoting layer between the silicon and subsequent metal layers, followed by a 600 Å thick layer of platinum (acts as a diffusion barrier to mobile ions in the silicon) and ends with a 2000 Å thick layer of gold (current carrying metal layer of the heater) (FIG. 3(*d*)). After coating the wafer with metals 308, the wafer is placed in an acetone bath which dissolves the undeveloped photoresist on the wafer leaving the desired metal pattern, which is heater 204. This process is known as lift-off (FIG. 3(*e*)). The wafer is then cleaned prior to the silicon etching.

The silicon in the pump can be machined using plasma based etching techniques. An etch process based on the spontaneous chemical reaction of neutrals with silicon is referred to as plasma etching. This process is referred to as reactive ion etching (RIE) if ion bombardment of the silicon plays a synergistic role in the chemical etch reaction. Inductively coupled plasma reactive ion etching (ICP RIE) have higher etch rates than RIE systems due to an increase in the density of ions and neutrals during etching.

Deep reactive ion etching systems were developed for the micromachining community in order to etch high aspect ratio features at rates much faster than those provided by traditional RIE systems (0.1 to 0.5 μm/min). Many DRIE systems follow a method patented by Robert Bosch GmbH in which etch and passivation cycles alternate in an ICP RIE system.

A DRIE system that can be used for the thermal guard fabrication is an ICP PIE manufactured by Surface Technology Systems (STS) of Imperial Park, Newport, NP10 8UJ, UK. The STS DRIE utilizes the alternating etch and passivation cycles to etch the silicon. Silicon wafers can be patterned with photoresist layers in order to selectively etch desired features. The photoresist protects the underlying silicon during etching and is etched at a much slower rate than does silicon. The etch selectivity of silicon to photoresist is about 75:1 since every 75 μm of silicon etched requires 1 μm of photoresist to protect underlying silicon areas. The hole arrays that have been tested consist of 20 μm diameter holes spaced by 40 μm in a central 0.5 $cm^2$ area per thermal guard. The batch fabrication methods of MEMS processing allows nearly $1.4\times10^4$ holes to be fabricated simultaneously in each thermal guard (8.75% open area in the array). The open area can be increased by decreasing the spacing between holes although this will reduce the structural strength of the thermal guard. For MEMS devices, a hole spacing of 40 μm generally ensures good processing yield. The DRIE process provides the high aspect ratio, high feature density and through wafer etching capabilities. A front and back side etch using the STS DRIE realizes the 20 μm diameter hole array through the 400 μm thick silicon wafers. Due to a system imposed 30:1 aspect ratio limit the etching is separated into two separate 20:1 aspect ratio etches in order to achieve an aspect ratio of 40:1. A back side alignment using wafer and mask alignment marks allows the front and back side features to meet within ±2 μm.

A silicon etch process for the thermal guards is illustrated in FIG. 4. It begins with coating a layer of photoresist 402 on the same side as the deposited heaters 204 (FIG. 4(*a*)). The wafer 304 is UV exposed in the mask aligner 404 once it has been aligned using deposited metal alignment marks generated from the heater mask with those on the etch mask (FIG. 4(*b*)). The wafer is then placed in a developer bath to develop the hole and device pattern in the photoresist (FIG. 4(*c*)). The wafer is subsequently loaded into the STS DRIE to anisotropically etch the desired silicon features (FIG. 4(*d*)).

The first etch is completed at a depth of 200 μm and the wafer is subsequently cleaned of photoresist. A photoresist layer is deposited on the back side of the wafer for patterning. A back side alignment using the alignment marks on the wafer's front side with those of the etch mask ensure proper alignment. The wafer is then placed on a carrier wafer (photoresist side up) and secured with wax to ensure that the STS chuck is not damaged upon etching through the device wafer. After a total of 210 minutes of etching, the individual thermal guards have been machined. A thorough cleaning removes residual photoresist and wax from the devices. A check of the hole array alignment can be made by cleaving one of the thermal guards along its hole array.

Thermal transpiration over useful pressure ranges in a pump uses a material that has both low thermal conductivity and small internal pores. The use of an aerogel membrane enables the construction of a MEMS version of the pump. Aerogels are a special class of continuously porous solid materials which are characterized by nanometer size particles and pores. These materials have an average composition of only 5% solid material ($SiO_2$) and 95% open space leading to the commonly referred name "frozen smoke." This rather empty structure, results in a thermal conductivity that varies with the ambient pressure (17 mW/mK at 760 Torr and 8 mW/mK at p<1 Torr). In the MEMS pump, a plain silica based aerogel can be used and its properties are listed in Table 2.

Pyrex 7740 and aluminum 6061 can be conventionally machined in order to make MEMS device vacuum connectors. Each pyrex piece 106, which can be a glass ring with an inner diameter of 1 cm, an outer diameter of 1.5 cm and thickness of 2 mm, can be anodically bonded to the silicon 102 and acts as a gas plenum. The aluminum connectors 108, which have similar dimensions and shape to the pyrex plenum 106 on one end and a straight 4.5 cm length of 0.635 cm diameter tubing on the other end, can then bonded to the pyrex plenums using Torr Seal epoxy 110. Cajon® Ultra Torr O-ring sealing vacuum connectors (not shown) can then attached to the aluminum tube ends in order to attach vacuum and gas input lines. These lines and the rest of the connecting system tubing can be connected together using Swagelok® vacuum fittings to ensure leak-tight operation of the MEMS devices.

Vacuum tight sealing of the various pump components is important to determining actual device performance. The small pressure differences generated (<20 Torr) across a single stage dictate that the device and system be substantially leak-tight. Even small leaks cannot be distinguished from the thermal transpiration pressure increases very easily. Anodic bonding of the pyrex plenums to the silicon thermal guards ensures the required vacuum tight seal.

Anodic bonding is the preferred method of bonding between plenum and thermal guard since epoxy may plug holes in the thermal guard hole arrays. A thin bead of Torr Seal epoxy 110 around the perimeter of the thermal guard and aerogel membrane sandwich was found to be the preferred method of forming the seal between the thermal guard and the transpiration membrane. An additional epoxy bond 112 between each pyrex plenum and aluminum vacuum connector provide the final vacuum seals.

Anodic bonding is a method of electrostatically bonding two dissimilar materials to form a strong, hermetic seal that involves little alteration in the shape, size and dimensions of the materials forming the joint. This method is a commonly used method for joining glass to silicon for micromechanical applications. The bonding is accomplished between a conductive substrate and a sodium-rich glass substrate. In the pump, the conductive substrates are the silicon thermal guards 102 and the glass substrates are the pyrex plenums 106.

An Electronic Visions AB1-PVS anodic bonding system can be used to perform the anodic bonding for the MEMS device components. Bonding can be performed under vacuum ($p<1\times10^{-5}$ Torr) and at a heater temperature of 375° C. The application of a temperature in the range of 350–450° C. is sufficient to make the sodium ions in the glass mobile. The application of a 750 V potential across the parts for 10 minutes, with the pyrex held at a negative potential, causes mobile positive ions (mostly $Na^+$) in the pyrex to migrate away from the silicon-pyrex interface towards the cathode, leaving behind fixed negative charges. The electrostatic attraction between the fixed positive charges in the silicon and negative charges in the pyrex holds the two materials together and facilitates the chemical bonding of silicon to pyrex. During the required bonding for the MEMS devices, only one thermal guard and plenum are bonded at a time. This is done to ensure accurate alignment between the plenum's inner diameter and the thermal guard array since once bonded the parts cannot be separated without incurring damage to the pieces.

An epoxy bond between the silicon chips and the aerogel can be used in the MEMS device assembly in order to ensure a vacuum seal.

After anodic bonding the hot and cold thermal guards to their pyrex plenum, the final device assembly using Torr Seal® epoxy is accomplished. In order to facilitate device handling, the other side of each pyrex plenum is epoxy bonded to the aluminum connector. A thin bead of this vacuum epoxy between two materials and the addition of minimal force is adequate to form the bond. Once cured, the parts are then assembled with the aerogel membrane between the two parts.

Figure 5A:
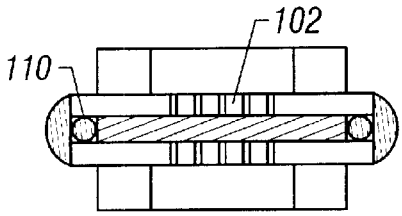
FIG. 5 is a schematic of epoxy bonded near the aerogel shown in FIG. 1.
Figure 5B:
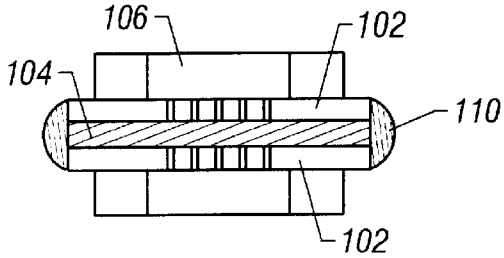

FIG. 5 shows two identically fabricated single stage devices that are epoxy bonded near the aerogel 104 slightly differently. The first version (FIG. 5(*a*)) can be assembled using two separate beads of epoxy 110 to validate the epoxy as a viable sealing approach and to ensure that the device is leak-tight. The first bead is placed on the face of one thermal guard 102 prior to the addition of the aerogel membrane 104 and the second thermal guard. Adequate force is applied to the assembly to ensure that the thermal guards were in good thermal contact to the faces of the aerogel membrane and that the bond created a vacuum seal. The second bead around the perimeter of the device thickness completes the bonding.

The second device (FIG. 5(*b*)) uses a wider aerogel membrane that was the same dimensions as the thermal guard chips and only has an epoxy bead around the perimeter of the device thickness. This is done in order to minimize the heat conduction path between the hot and cold thermal guards since Torr Seal epoxy has a much higher thermal conductivity than aerogel. These bonding approaches result in different device heat transfer, which correspond to different performances, due to the location and amount of epoxy used.

In order to provide useful pumping for portable and in situ instruments most pumps will be composed of many stages. A minimum energy consumption cascade most likely will incorporate a range of capillary or pore sizes in the transpiration material 104. The pump design permits incorporation of transpiration membranes with a wide range of pore diameters for the pressure range of pumping. A 10 mTorr to 760 Torr pump requires about 50 $\mu$m to 0.05 $\mu$m pore diameters. The transpiration membrane should preferably have a thermal conductivity less than 0.01 W/mK for minimal heat conduction.

Figure 6:
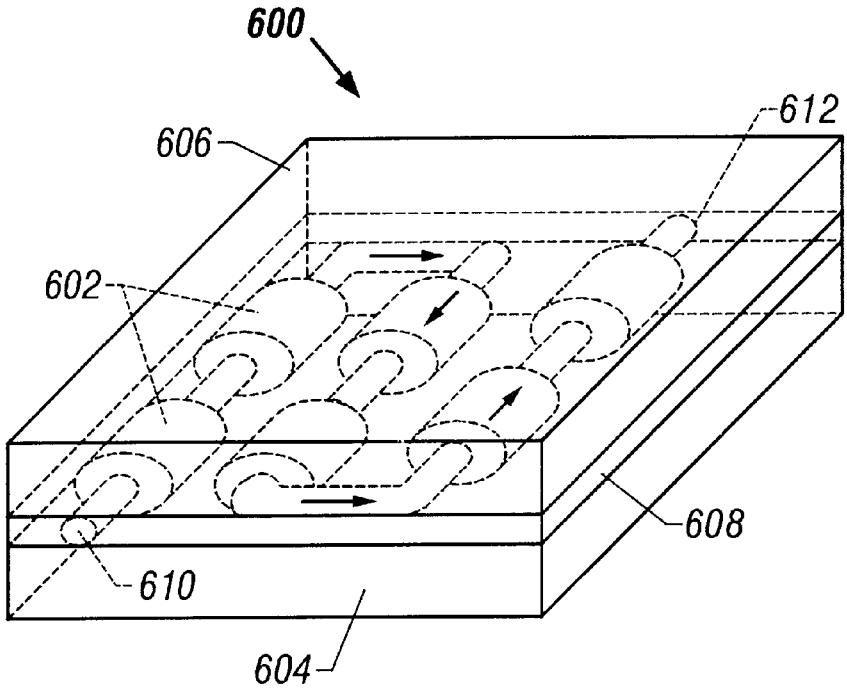
FIG. 6 is a layout schematic of a multiple-stage pump configured according to the present invention.

A cascade design is illustrated in FIGS. 6. Gas volumes can be used as a means of thermal isolation in the pump. This is preferably utilized since even glasses can conduct intolerable amounts of thermal energy at microscales. Pyrex 7740 ($K_m$=1.1 W/mK) with a typical micromachine temperature difference of 100 K over 100 $\mu$m will conduct 1.13 W/mm$^2$ . On the other hand, if the 100 $\mu$m is stagnant $N^2$ gas ($K_g$=24.4 mW/mK), the heat conduction is 24.4 mW/mm$^2$ (45 times lower than pyrex). Due to this fact of heat transfer at the microscales, the hot thermal guards for each stage should preferably be surrounded by either the gas being pumped or the transpiration membrane.

A microscale pump can pump $N^2$ gas through a micro mass spectrometer from an initial low pressure to 760 Torr. Table 3 outlines the cascade sizing and energy consumption values for a desired molecule flow rate (N) through the mass spectrometer. Note the relatively large volume required for pumping $2\times10^{14}$ molecules/s from 1 mTorr to 10 mTorr compared to that required to pump a greater flow rate in the higher pressure ranges.

TABLE 3

| Pressure range | N, molecules/s | Number of stages | Q, W | V, cm$^3$ |
|---|---|---|---|---|
| 1 mTorr–10 mTorr | $2\times10^{14}$ | 125 | 1.55 | 8.99 |
| 10 mTorr–50 mTorr | $5\times10^{15}$ | 36 | 0.301 | 1.78 |
| 50 mTorr–760 mTorr | $5\times10^{15}$ | 141 | 0.146 | 0.814 |

Pumps that provide pumping over several orders of magnitude in pressure requires the use of many stages. The design for such a pump 600 is illustrated in FIGS. 6. Each stage 602 is composed of a transpiration membrane 702 sandwiched between a hot and cold thermal guard 704, 706. FIG. 6 shows the stage configuration within a micromachined silicon (base 604 and lid 606) and pyrex (spacer) housing 608. During assembly of the pump, stages are placed at designated locations in the housing. The housing provides the structural support and thermal contact to the cold side of each stage. Stages are fabricated separately and are assembled prior to their placement in the housing. The following fabrication discussion outlines a method with some unique and innovative techniques for the creation of pump cascades.

Because multiple and possibly identical stages are needed in the pump, pump batch fabrication is fundamental. The stage components and dimensions are outlined in FIG. 7. Each stage 602 includes a thermal transpiration material 702, which is supported and housed by a thin polymethylmethacrylate (PMMA) cylinder 708, that is sandwiched between a hot and cold thermal guards 704, 706. PMMA typically has a density of 1.19 g/cm$^3$ and a thermal conductivity of 0.18 W/mK.

Depending on the desired pore size of the transpiration material, a packed assembly of small spheres (ceramic, glass or other material) or an aerogel membrane can be utilized. A 400 $\mu$m thick transpiration layer 702 with an area of 1.54 mm$^2$ is inserted inside the PMMA cylinder 708. The PMMA cylinder can have a wall thickness of 5 $\mu$m (preferably) to 10 microns, a length of 400 $\mu$m and an inner diameter of 1.4 mm. It can be fabricated using the standard X-ray lithography patterning techniques employed in LIGA. These particular thermal guards can be 400 $\mu$m thick silicon chips that are 1.6 mm by 1.6 mm in area. Many of these guards can be machined simultaneously using the STS DRIE system which anisotropically etches the desired features from a 100 mm diameter silicon wafer. Both guards can have a central 1 mm$^2$ area with a dense array 710 of 20 $\mu$m diameter holes etched through the guard's thickness to allow for gas passage. The holes can be separated from each other by 25 $\mu$m forming an effective open area to the flow of 15%. The hot side thermal guard 704 has a patterned thin-film heater 712 on one surface (see FIG. 7) to provide the desired warm temperatures during operation.

A skilled artisan will recognize that the cross-sectional area of the thermal guards and the transpiration material is dependent upon the pumping rate of the gas (see Table 3). Further, as the transpiration material becomes longer, the pumping rate will be reduced. The pore size of the transpiration material is a function of the inlet pressure, for example, the pore size is such that the Knudsen number is approximately 1 so that the thermal transpiration can occur.

Figure 7:
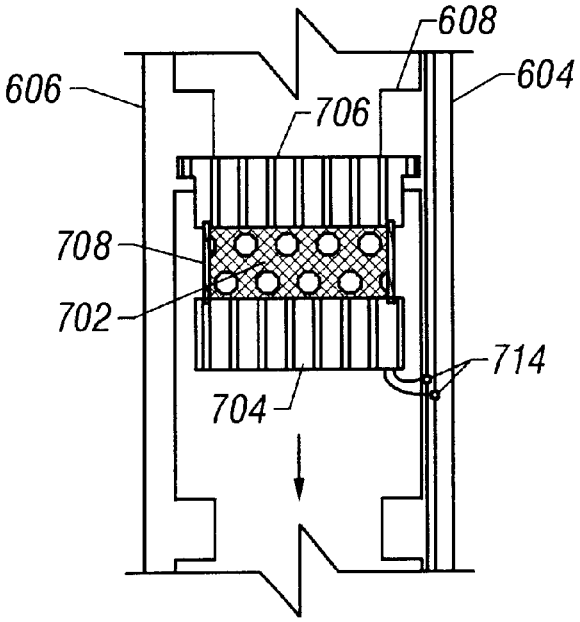
FIG. 7 is a simplified top view of an embodiment of a stage of the pump shown in FIG. 6.

Once the components have been fabricated they can be bonded together as shown in FIG. 7. The hot and cold side thermal guards have an etched trench for inserting and locating the PMMA cylinder. The assembly begins with inserting the PMMA cylinder into the hot side guard's trench. A thin layer of high-temperature, conductive epoxy can be utilized to secure the PMMA to the guards. The transpiration material is then placed into the PMMA cylinder. The cold side guard is then secured to the PMMA cylinder to complete the stage fabrication.

The housing (see FIG. 6) provides support to the stages as well as for thermal control of the cascade. The housing can be made from two 1 mm thick silicon wafers (base 604 and lid 606) that can be machined using the STS DRIE and a 400 $\mu$m thick Pyrex 7740 wafer 608 (spacer) that has been ultrasonically machined. Each silicon part can have its features etched 600 $\mu$m deep into their thickness and are stacked with the pyrex spacer to provide the 1.6 mm tall cavities necessary for stage insertion. The base wafer 604 has a thin layer of patterned gold on its upper surface to provide electrical contacts to the hot side integrated heater contacts 714. Electrical contact between each stage's heater and the base's metal contact pads can be made using small gold wire bonds. The base wafer is slightly larger in size than the lid and spacer wafers in order for electrical contact to be made to the pump. The pyrex spacer can be machined using an ultrasonic machining system to provide the desired structure in the glass. Ultrasonic machining can easily provide the dimensional accuracy (minimum feature size ~50 $\mu$m) needed for the vacuum seal around the perimeter of the device and the seal between stages.

Once the housing wafers and the stages are fabricated the cascade assembly and pump packaging are initiated. The packaging begins by first anodically bonding the pyrex spacer to the base wafer. The assembled stages are then placed in the housing cavities. The cold thermal guard of each stage is located in intimate contact with the housing along each cavity's etched sidewall. This is done in order to use the housing ($K_m$=150 W/mK for silicon) as a heat sink so that each cold thermal guard is effectively cooler than the hot thermal guards. The electrical contacts between each stage and the base are then made using gold wire bonds. The lid is sealed to the pyrex wafer using a thin layer of Torr Seal epoxy to complete the package. Electrical contacts to the pump are made using a pair of bond pads located on the end of the base wafer. Conventionally machined inlet and outlet vacuum connectors are then attached to the pump inlet 610 and pump outlet 612 using Torr Seal epoxy to complete the fabrication.

Figure 8:
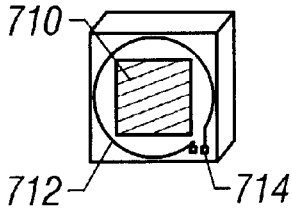
FIG. 8 is a bottom view of the embodiment of the stage shown in FIG. 7.

Power consumption for the staged design of FIGS. 6 through 8 is predominantly from the following: conduction through the transpiration membrane from the hot to the cold thermal guards; conduction through the working gas that surrounds the hot thermal guards; conduction through the PMMA from the hot to the cold thermal guards; and radiation from the hot thermal guards to the surroundings. Assuming a stage operating with a $\Delta T$=100 K and $T_{AVG}$=350 K, a carbon-loaded aerogel transpiration membrane with a thermal conductivity of 4.2 mW/mK and a silicon emissivity of 0.2 allow the estimated energy losses to be determined. The losses are 1.6 mW through the membrane, 0.1 mW through the working gas, 1.0 mW through a 5 $\mu$m wide PMMA cylinder and 0.5 mW radiated from the hot guard. For a compactly stacked cascade of 177 stages in a 2.6 cm$^3$ package that pumps from 10 mTorr to 760 Torr, the total power consumption of 0.57 W requires a temperature drop of only about 1 K between the stages and the housing. This small drop may be easily provided by a variety of heat sinks.

Serious fabrication issues involve the transpiration membrane since aerogel is fragile and may not be available in a wide enough range of pore sizes. Another possibility would be to use micro/nano sized spheres for the transpiration membrane. The effective thermal conductivity of a bed of packed spheres scales with the thermal conductivity of the gas in the bed. In many for instances this value can be acceptably low. Packed spherical particles with a narrow size range provide pores with a characteristic dimension of about 20% of the mean sphere diameter and a wide variety of micro/nano spheres of various materials with narrow size ranges are commercially available. Both aerogels and small spheres can be used for the fabrication of functional pump cascades.

Those skilled in the art will recognize that other modifications and variations can be made in the pump of the present invention and in construction and operation of this pump without departing from the scope or spirit of this invention.

What is claimed is:

1. A gas pump comprising:

a first thermal guard having holes therethrough which allow passing a gas;

a second thermal guard having holes therethrough which allow passing the gas;

a porous, thermal transpiration material disposed between the first thermal guard and the second thermal guard; and a heating mechanism to maintain a temperature difference between the thermal guards across the thermal transpiration material;

and wherein the porous thermal transpiration material has a pore diameter between about 0.5 micrometers and about 50 micrometers.

2. The gas pump of claim 1 wherein the first thermal guard comprises a silicon chip having an array of holes having a pore diameter of about 20 micrometers.

3. The gas pump of claim 2 wherein the array of holes cover an area of about 0.5 centimeters squared and the holes are separated by about 40 micrometers.

4. The gas pump of claim 2 wherein the array of holes cover an area of about 1.0 millimeters squared and the holes are separated by about 25 micrometers.

5. The gas pump of claim 1 wherein the first thermal guard comprises a silicon chip having a thickness of about 400 micrometers.

6. The gas pump of claim 1 wherein the first thermal guard comprises a silicon chip having a thermal conductivity of about 150 watts per milliKelvin.

7. The gas pump of claim 1 wherein the second thermal guard comprises a silicon chip having an array of holes having a pore diameter of about 20 micrometers.

8. The gas pump of claim 7 wherein the array of holes cover an area of about 0.5 centimeters squared and the holes are separated by about 40 micrometers.

9. The gas pump of claim 7 wherein the -array of holes cover an area of about 1.0 millimeters squared and the holes are separated by about 25 micrometers.

10. The gas pump of claim 1 wherein the second thermal guard comprises a silicon chip having a thickness of about 400 micrometers.

11. The gas pump of claim 1 wherein the second thermal guard comprises a silicon chip having a thermal conductivity of about 150 watts per milliKelvin.

12. The gas pump of claim 1 wherein the porous thermal transpiration material has a thermal conductivity less than about 0.017 watts per milliKelvin.

13. The gas pump of claim 1 wherein the porous thermal transpiration material has a pore diameter of about 20 micrometers.

14. The gas pump of claim 1 wherein the porous thermal transpiration material has a thickness of about 520 micrometers.

15. The gas pump of claim 1 wherein the porous thermal transpiration material has a thickness of about 400 micrometers.

16. The gas pump of claim 1 wherein the porous thermal transpiration material comprises an aerogel membrane.

17. The gas pump of claim 1 wherein the porous thermal transpiration material comprises packed spherical particles.

18. The gas pump of claim 17 wherein the spherical particles are made of glass or ceramic.

19. The gas pump of claim 1 wherein the thermal transpiration material is coupled to the first thermal guard and the second thermal guard.

20. The gas pump of claim 19 wherein the seal is formed by an epoxy sealant material.

21. The gas pump of claim 19 wherein the seal is formed by a polymethylmethacrylate material.

22. The gas pump of claim 1, wherein the first thermal guard comprises silicon.

23. The gas pump of claim 22, wherein the Knudsen number in the thermal guards is in the order of 100 times the Knudsen number in the thermal transpiration material.

24. The gas pump of claim 22, wherein the heating mechanism includes a metal disposed on the first thermal guard.

25. A gas pump comprising:

a first thermal guard having holes therethrough which allow passing a gas;

a second thermal guard having holes therethrough which allow passing the gas;

a porous, thermal transpiration material disposed between the first thermal guard and the second thermal guard; and a heating mechanism to maintain a temperature difference between the thermal guards across the thermal transpiration material, wherein the heating mechanism includes a metal disposed on the first thermal guard.

26. The gas pump of claim 25, wherein the first thermal guard comprises a silicon chip having an array of holes having a pore diameter of about 20 micrometers.

27. The gas pump of claim 26 wherein the array of holes cover an area of about 0.5 centimeters squared and the holes are separated by about 40 micrometers.

28. The gas pump of claim 26, wherein the array of holes cover an area of about 1.0 millimeters squared and the holes are separated by about 25 micrometers.

29. The gas pump of claim 25 wherein the first thermal guard comprises a silicon chip having a thickness of about 400 micrometers.

30. The gas pump of claim 25 wherein the first thermal guard comprises a silicon chip having a thermal conductivity of about 150 watts per milliKelvin.

31. The gas pump of claim 25 wherein the second thermal guard comprises a silicon chip having an array of holes having a pore diameter of about 20 micrometers.

32. The gas pump of claim 31 wherein the array of holes cover an area of about 0.5 centimeters squared and the holes are separated by about 40 micrometers.

33. The gas pump of claim 31 wherein the array of holes cover an area of about 1.0 millimeters squared and the holes are separated by about 25 micrometers.

34. The gas pump of claim 25 wherein the second thermal guard comprises a silicon chip having a thickness of about 400 micrometers.

35. The gas pump of claim 25 wherein the second thermal guard comprises a silicon chip having a thermal conductivity of about 150 watts per milliKelvin.

36. The gas pump of claim 25 wherein the porous thermal transpiration material has a thermal conductivity less than about 0.017 watts per milliKelvin.

37. The gas pump of claim 25, wherein the first thermal guard comprises silicon.

38. A gas pump comprising:

a first thermal guard having holes therethrough which allow passing a gas;

a second thermal guard having holes therethrough which allow passing the gas;

a porous, thermal transpiration material disposed between the first thermal guard and the second thermal guard; and a heating mechanism to maintain a temperature difference between the thermal guards across the thermal transpiration material;

and wherein the Knudsen number in the thermal guards is in the order of 100 times the Knudsen number in the thermal transpiration material.

39. The gas pump of claim 38, wherein the first thermal guard comprises a silicon chip having an array of holes having a pore diameter of about 20 micrometers.

40. The gas pump of claim 39 wherein the array of holes cover an area of about 0.5 centimeters squared and the holes are separated by about 40 micrometers.

41. The gas pump of claim 39 wherein the array of holes cover an area of about 1.0 millimeters squared and the holes are separated by about 25 micrometers.

42. The gas pump of claim 38 wherein the first thermal guard comprises a silicon chip having a thickness of about 400 micrometers.

43. The gas pump of claim 38 wherein the first thermal guard comprises a silicon chip having a thermal conductivity of about 150 watts per milliKelvin.

44. The gas pump of claim 38 wherein the second thermal guard comprises a silicon chip having an array of holes having a pore diameter of about 20 micrometers.

45. The gas pump of claim 44 wherein the array of holes cover an area of about 0.5 centimeters squared and the holes are separated by about 40 micrometers.

46. The gas pump of claim 44 wherein the array of holes cover an area of about 1.0 millimeters squared and the holes are separated by about 25 micrometers.

47. The gas pump of claim 38 wherein the second thermal guard comprises a silicon chip having a thickness of about 400 micrometers.

48. The gas pump of claim 38 wherein the second thermal guard comprises a silicon chip having a thermal conductivity of about 150 watts per milliKelvin.

49. The gas pump of claim 38 wherein the porous thermal transpiration material has a thermal conductivity less than about 0.017 watts per milliKelvin.

50. The gas pump of claim 38, wherein the first thermal guard comprises silicon.

* * * * *

UNITED STATES PATENT AND TRADEMARK OFFICE

CERTIFICATE OF CORRECTION

PATENT NO. : 6,533,554 B1 
DATED : March 18, 2003
INVENTOR(S) : Geoff R. Shiflett, Stephen E. Vargo and E. Phillip Muntz It is certified that error appears in the above-identified patent and that said Letters Patent is hereby corrected as shown below:

Column 1,
Line 9, insert the following paragraph before "BACKGROUND OF THE INVENTION":

-- This invention was made with government support under Contract No. NAG 5-10399 awarded by NASA. The government has certain rights in the invention. --

Signed and Sealed this

Twenty-first Day of December, 2004

JON W. DUDAS
*Director of the United States Patent and Trademark Office*